United States Patent [19]

Creff

[11] Patent Number: 4,794,504

[45] Date of Patent: Dec. 27, 1988

[54] REFLECTOR FOR AUTOMOBILE HEADLIGHT WITH IMPROVED FULL BEAM

[75] Inventor: Rene L. Creff, Sens, France

[73] Assignee: Neiman, Courbevoie, France

[21] Appl. No.: 68,291

[22] Filed: Jul. 1, 1987

[30] Foreign Application Priority Data

| | | | |
|---|---|---|---|
| Jul. 16, 1986 | [FR] | France | 86 10339 |
| Nov. 24, 1986 | [FR] | France | 86 16319 |
| Dec. 24, 1986 | [FR] | France | 86 18141 |

[51] Int. Cl.[4] ..... F21V 7/00

[52] U.S. Cl. ..... 362/348; 362/346

[58] Field of Search ..... 362/215, 346, 348

[56] References Cited

U.S. PATENT DOCUMENTS

| | | | |
|---|---|---|---|
| 1,199,071 | 9/1916 | Heckert | 362/348 |
| 4,349,866 | 9/1982 | Molnar | 362/348 |
| 4,531,018 | 9/1982 | Fratty | 362/346 |

*Primary Examiner*—Carroll B. Dority, Jr.

*Attorney, Agent, or Firm*—James Creighton Wray

[57] ABSTRACT

This invention relates to a reflector for an automobile headlight comprising a reflecting quadric having substantially the surface of a paraboloid of revolution intersected by upper and lower truncation planes, an electric lamp filament being situated substantially at the focus of said quadric to provide full beam lighting by reflection on said quadric of the luminous beams emitted by said filament and traversed by an optical glass situated in front of said quadric. The reflector according to this invention is characterized by the fact that at least the lower truncation plane of the reflector is equipped, on its internal surface illuminated by the full beam filament of the electric lamp, with a plurality of reflecting spherical elements spaced in a concentric arrangement comparable with Fresnel echelons with respect to their common axis passing through the focus of the useful reflecting conic of the reflector, this focus being also their common center.

6 Claims, 7 Drawing Sheets

REFLECTOR FOR AUTOMOBILE HEADLIGHT WITH IMPROVED FULL BEAM

BACKGROUND TO THE INVENTION

This invention relates to a reflector for an automobile headlamp comprising a reflecting quadric having substantially the surface of a paraboloid of revolution intersected by upper and lower truncation planes, an electric lamp filament being situated substantially at the focus of said quadric to provide full beam lighting by the reflection on said quadric of the light beams emitted by said filament and traversed by an optical glass situated in front of said quadric.

STATEMENT OF PRIOR ART

In present-day headlights of this type, of very shallow depth, in order to improve the aerodynamics and style of automobile vehicles, optical reflectors are used, the reflecting quadric of which is very restricted in height by two truncation planes, which cannot reflect, in a manner useful to the functions required, all the useful incident rays emitted by the lamp which illuminates them.

Furthermore, the current trends in design which tend towards the production of shapes and arrangements of these reflectors which favour, for two-function headlights of the "dipped beam" and "full beam" type, the production of the dipped beam to the detriment to some extent of the useful volume which provides the full beam function, thereby emphasize the need to find new devices adapted for effectively recovering all this lost light captured by said truncation planes, in order to obtain, with highly truncated reflectors, at least the same beam fluxes as those obtained with reflectors having a complete reflecting quadric with a conic or conics of evolution having the same parameter.

OBJECT OF THE INVENTION

This invention has as its objective the improvement of the full beam of headlights of the type described in the introduction.

SUMMARY OF THE INVENTION

For this purpose, the reflector according to this invention is characterized by the fact that at least the lower truncation plane of the reflector is equipped, on its internal surface illuminated by the full beam filament of the lamp which generates the light, with a plurality of reflecting spherical elements, spaced in a concentric arrangement comparable with Fresnel echelons with respect to their common axis passing through the focus of the useful reflecting conic of the reflector, this focus being also their common centre.

In one especially advantageous form of embodiment, the reflecting spherical elements concentrically arranged on the truncation plane have, in relation to their common centre passing through the focus of the reflecting quadric of the reflector, increasing evolutive radii to progress annularly at a constant pitch towards the opening plane of the reflector or limiting plane of truncation, the non-reflecting rakes of each groove of prismatic section thus formed on the truncation plane being constructed in such a manner that each limiting ray emitted by the lamp which illuminates the bottom of the groove is returned towards the lamp without skimming the plane formed by said rakes.

In one variant, the reflecting spherical elements spaced concentrically on the truncation plane have, in relation to their common centre passing through the focus of the reflecting quadric of the reflector, constant evolutive radii to progress annularly at a variable progressive pitch towards the opening plane of the reflector or limiting truncation plane, the reflection of each intercepted ray being unable to skim the flank formed by the corresponding rakes of each concentric optical groove formed.

In another form of embodiment of the invention, it is provided that the reflecting spherical elements spaced concentrically on the truncation plane have, in relation to their common centre passing through the focus of the reflecting quadric of the reflector, increasing evolutive radii such that they provide a variable pitch and a constant height for the useful zones of said spherical elements illuminated by the useful incident rays emitted by the "full beam" filament of the lamp, the rays reflected by said zones not brushing the flanks formed by the rake of each groove formed.

This last characteristic offers the advantage that it is possible to form a less cramped spacing of the reflecting spherical elements, since this process makes it possible at least to construct every second groove while at the same time substantially preserving the same useful reflective volume of the recuperative device forming the subject of this invention.

According to one variant, the reflector is characterized by the fact that each reflecting surface of the spaced spherical elements of the reflector is constituted by the juxtaposition of a plurality of microfacettes individually orientated in such a manner as to reflect the incident rays, intercepted dipped beam and/or full beam rays, which they must send back to the useful surface of the conic of the quadric, with a deviation in the angle of reflection such that these reflected rays avoid passing through the bulb of the lamp, and, after a second reflection by the corresponding zone of the useful reflecting surface of the reflector conic, complete and homogenize the basic lighting beam obtained by the reflection of the rays alone of the luminous source which directly light the reflecting surface of said principal conic of the reflector.

Preferably, the juxtaposition, the dimensional evolution and the orientation of the orientated reflecting microfacettes determine, for a part or the whole of the spaced elements and a part or the whole of the reflective surface of each of said echelons, a monotonous evolutive surface.

According to another variant which has the objective, by means of a particular structure of the reflector, of permitting optimum metallization and protection of these reflecting surfaces of the spaced elements, the reflector is characterized by the fact that, at least during the metallization and protection operations, said reflector is equipped with at least one rear opening between the reflecting quadric and a truncation plane comprising spaced spherical reflecting elements.

Such an opening enables the spaced, reflecting surfaces, facing towards the rear of the reflector, to be effectively exposed to the sprays of materials intended for forming the metallization and the protection of the reflector during the corresponding processes. In addition, it favours the cooling of the headlight.

The invention will be better understood by means of the attached drawings which relate to the following description of examples of embodiment of the invention.

DESCRIPTION OF REFERRED EMBODIMENT

Figure 1:
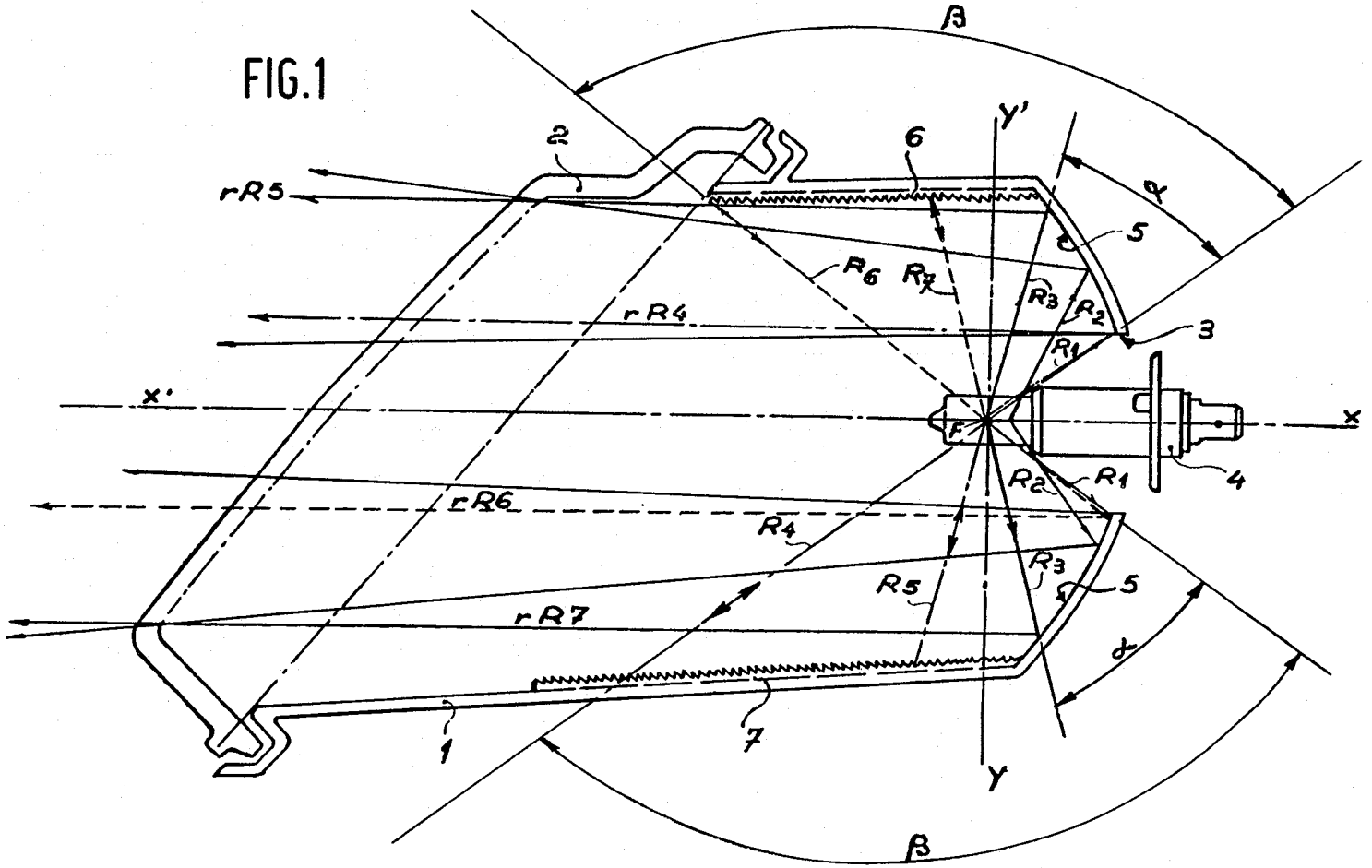
FIG. 1 is a schematic view in axial longitudinal section of a single-function "full beam" headlight having a reflector according to this invention.

Reference is made firstly to FIG. 1. The reflector 1 of the headlight is obturated at the front by a glass 2 and seats, in a rear orifice 3, a single-function lamp 4, of which the filament emitting the light is positioned strictly in accordance with the common ratio of $\frac{1}{3}$-$\frac{2}{3}$ with respect to the focus F of its reflecting quadric 5, on the focal axis x'x, in such a manner as to generate the divergent-convergent "full beam". Respectively, the propagation of the limiting rays $R_1$ emitted by the last turn and $R_2$ emitted by the first turn of the filament are indicated in order to define, in this vertical focal plane corresponding to the plane of the figure, the solid angle $\alpha$ and the useful lighting area of the quadric 5 which can be utilized in the absence of the recuperator elements forming the subject of the present invention, and which depend notably upon the diameter of the lamp orifice 3 and upon the maximum useful working height of the glass 2 on the one hand, and upon the useful height of the quadric 5 capable of reflecting, parallel to the axis x'x, the ray $R_3$ emitted by the turn of the filament located at the focus F and which can thus reach the glass without being deflected by the nearest truncation plane, on the other hand.

The spaced elements or spherical mirrors 6 and 7 forming the subject of this invention, positioned respectively on the internal wall of the upper and lower truncation planes of the reflector, are concentric with respect to their common axis y'y passing through their common centre which is located at the same point as the focus F of the reflecting quadric 5 of the reflector. Their pitches and radii evolve, according to one of the stated secondary characteristics, to constitute reflective zones or grooves, the rakes of which are such that they form connecting planes for these zones which in no way interfere with the simultaneous reception and reflection of each of the limiting rays which illuminate each of the useful zones of said recuperative spherical echelons.

In this manner, limiting the explanation solely to the illuminating rays from the turn of the filament located at the focus F of the reflector, it will be noted that:

- the ray $R_4$ intercepted by one of the elementary spherical portions of the lower recuperator 7 is reflected back in the opposite direction, to intercept the limit of the reflecting quadric 5 at the upper level of the lamp orifice 3 which, in its turn, reflects this recovered ray in a direction $rR_4$ parallel to the focal axis x'x;
- the ray $R_5$ intercepted by another of the elementary spherical portions of the lower recuperator 7 is returned in the opposite direction towards the lamp and, reinforcing the ray $R_3$, intercepts the useful upper zone limit of the reflecting quadric 5, which can reflect it in turn parallel to the direction $rR_5$ without encountering any obstacle;
- the ray $R_6$ intercepted by one of the elementary spherical portions of the upper recuperator 6 is reflected back in the opposite direction, to intercept the limit of the reflecting quadric 5 at the lower level of the lamp orifice 3 which, in its turn, reflects this recovered ray in a direction $rR_6$ parallel to the focal axis x'x;
- the ray $R_7$ intercepted by another of the elementary spherical portions of the upper recuperator 6 is returned in the opposite direction towards the lamp and, reinforcing the ray $R_3$, intercepts the useful lower zone limit of the reflecting quadric 5, which can reflect it in turn parallel in the direction $rR_7$, without encountering any obstacle.

Thus, in this sole vertical focal plane and for the single turn of the filament located at the focus F, to which we are restricting ourselves here for the purposes of the description, all the rays from the source which previously could not be exploited comprised between each of the limiting recuperation rays $R_4$ to $R_7$ stated above, are deflected by the spherical elements of the recuperators 6 and 7 towards a useful working zone of the truncated reflecting quadric 5, which, consequently, reflects then in a direction parallel to the focal axis x'x towards the glass optic 2, thereby reinforcing the flux of the full lighting beam at the outlet from the headlight. The result achieved is, therefore, an increase in the solid lighting angle in all the sectors of the reflector where the reflecting quadric 5 is reduced by the truncation planes (angle $\beta$ in the plane of the figure) and subsequently results in a lighting optimization of the useful lighting area of the reflecting quadric 5 of the reflector, capable thereby of producing substantially the same illuminating power as that of a headlight equipped with a reflecting quadric having the same parameters but not truncated.

Figure 2:
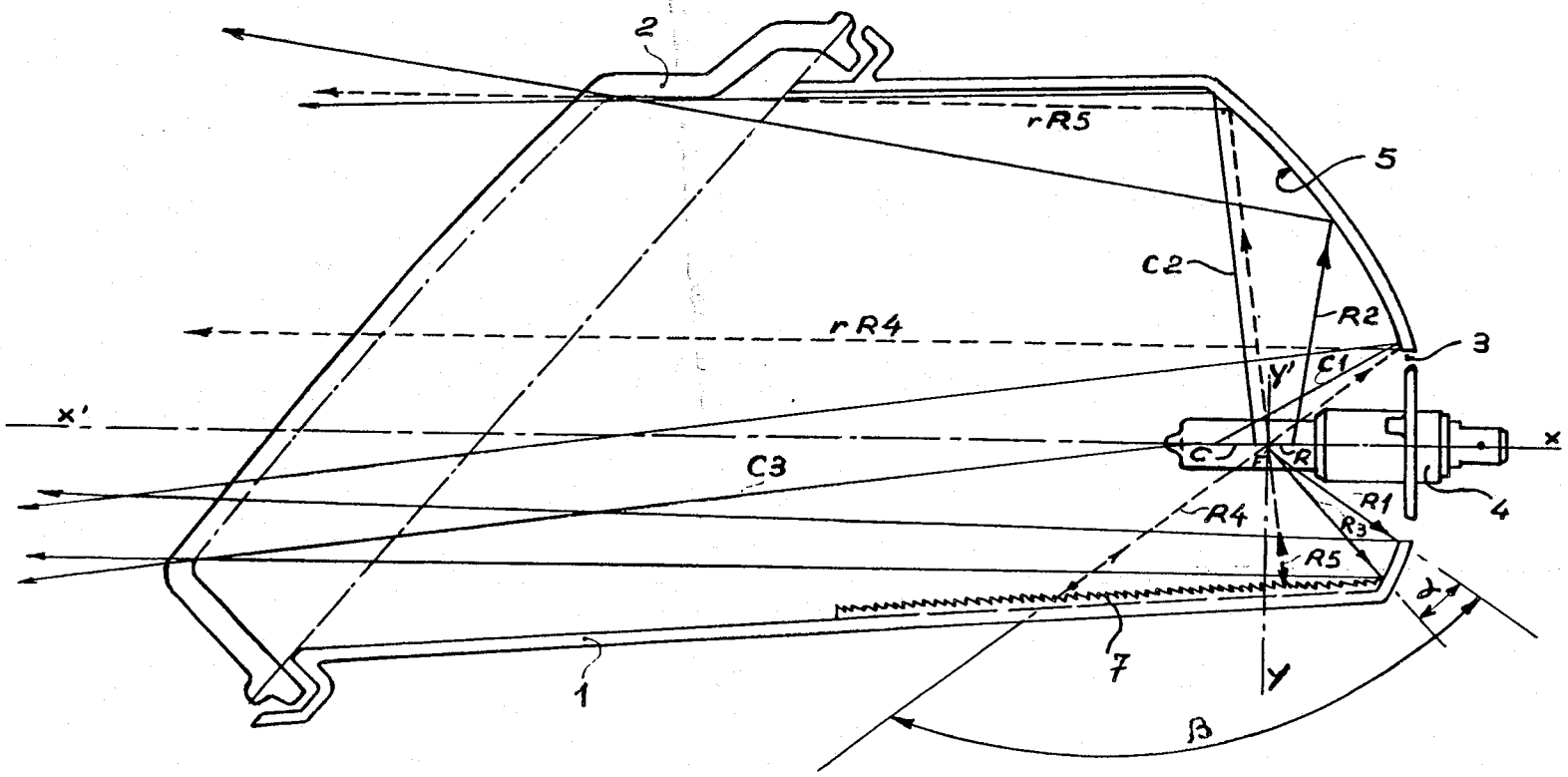
FIG. 2 is a schematic view in axial longitudinal section of a two-function "full beam" - "dipped beam" headlight having a reflector according to this invention.

Reference is now made to FIG. 2, which is a longitudinal section through a two-function headlight in the vertical focal plane coinciding here with the plane of the figure.

This "dipped beam" - "full beam" two-function headlight is equipped with a reflector of shallow depth, of which only the lower truncation plane 7 is illuminated by the full beam filament R, and consequently is provided with the spherical recuperation elements forming the subject of this invention, since all the zones of the upper and lower truncation planes utilizing the rays which form the dipped beam cannot be equipped with said recuperator mirrors.

In this FIG. 2, where the same references have been used for the equivalent elements to those of FIG. 1, the person skilled in the art will readily understand without detailed complementary explanation the arrangement and functioning of this headlight, the only important difference being that the full beam produced by this embodiment is not concentric with respect to the axis x'x but elongated in the vertical focal plane.

However, in this figure, there is also shown the propagation of the limiting rays of the convergent "dipped beam" which are emitted by the "dipped beam" filament C, situated for its part in front of the focus F of the quadric 5 of the reflector, that is to say the propagation of the limiting ray $C_1$ emitted by the last turn of said filament and passing just flush with the mounting orifice 3 for the lamp 4, and also that of the limiting ray $C_2$ emitted by the first turn of the same filament and passing at the limit of the truncation of the upper part of the reflecting quadric, and that of the limiting ray $C_3$ emitted by the same filament for determining the extreme definition point of the standardized cut-off line at 15° of the dipped beam for the lamp unit shown.

It is also possible to see from this figure the improvement provided by the spherical recuperation elements 7 in the useful solid lighting angle for forming the full beam in the highly truncated lower part of the reflector 1. Since this working angle for the plane of the figure concerned changes in practice from the value $\alpha$ to $\beta$ for the single turn of the full beam filament R located at the focus F of the quadric, it is immediately possible to judge the importance of the light recovered for the totality of the turns of the full beam filament concerned and the totality of the sectors of the reflector for the case where the highly truncated reflecting quadric would benefit only from a small useful reflecting area in the lower part.

Figure 3:
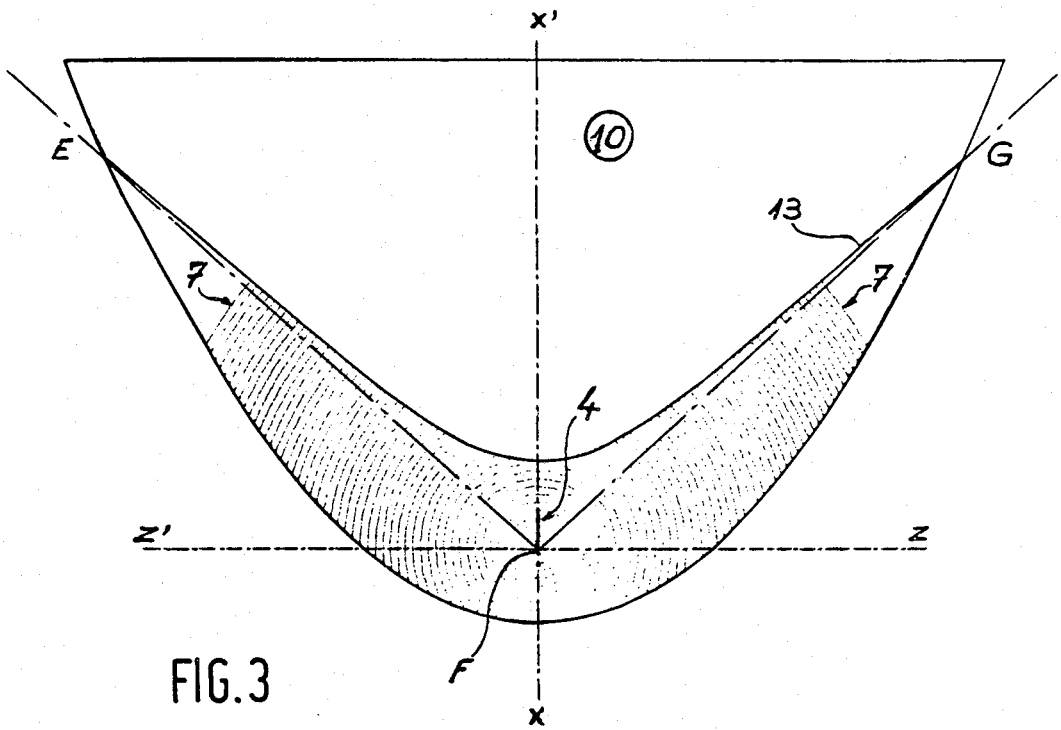
FIG. 3 is a schematic view from above of the reflector of FIG. 2.
Figure 4:
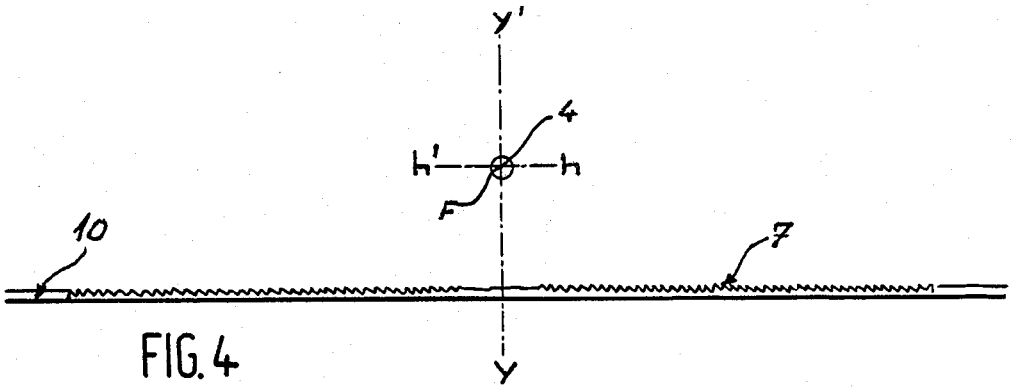
FIG. 4 is a view in section along the angled sectional plane EFG of FIG. 3 as viewed in the plane of FIG. 3.

FIG. 3 shows a view from above of a two-function reflector in accordance with this invention, in section on the horizontal focal plane h'h. This view shows notably the arrangement and the sufficient limitation of the spherical recuperator elements formed in echelons on the lower truncation plane 10 of a reflector having a parabolic reflecting quadric with the equation $y^2=105x$, sectioned parallel to its horizontal focal plane h'h by said truncation plane at 28mm distance from said reference focal plane. In FIG. 4, the profile is shown of said spherical recuperator elements 7 sectioned along the plane EFG and folded back or developed in the plane Z'Z perpendicular to the longitudinal focal plane y'y and parallel to the plane of the lighting aperture of the reflector, or brought into the plane of representation of FIG. 3.

Figure 5:
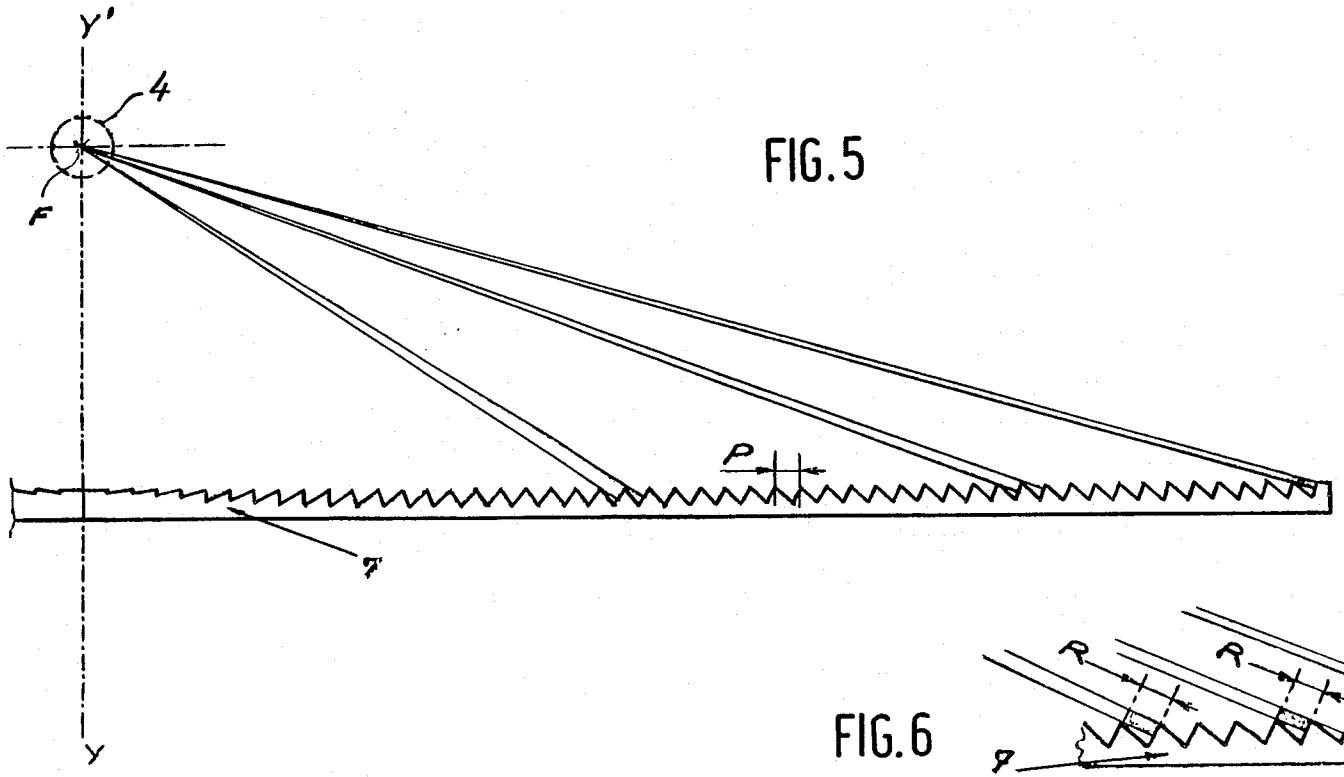
FIG. 5 is an enlarged view of a portion of the reflector of FIG. 3, the spherical elements having an increasing evolutive radius and a constant pitch.

In FIGS. 3, 4 and 5, it can be seen that the limiting curve 13 of the length of the spherical recuperator elements 7 that are useful for the effective recovery of the rays emitted by a full beam filament 4 is given by the intersection of a ruled or lined surface passing through the focus F of the conic quadric $y^2=105x$, the contour of the lamp orifice and the lower truncation plane 10 concerned, located at -28 mm from the horizontal focal plane h'h (the ruled surface containing therefore all the forward recoverable limiting rays referenced by $R_4$ in FIGS. 1 and 2).

The examples of embodiment of the spherical recuperator elements forming the subject of this invention and shown in the various figures are, of course, in no way exhaustive or limiting; indeed, these spherical recuperation elements may also, for example, equally well be constructed within the thickness of the wall of the truncation plane concerned intersecting the quadric of the reflector, instead of being realized in relief on the internal face of the same plane, or again they may be formed in an auxiliary optical plate attached to the internal face of said truncation plane of the reflector. This auxiliary plate may, in its turn, issue from an embellisher or raised portion continuing forwards the lighting aperture of the reflector, or again may come from a metallized rear continuation of the glass penetrating into the interior of the reflector to cover over said internal face of the intended truncation plane.

The spherical recuperator elements may, depending upon the possible functions of the reflector, constitute either concentric rings over the entire parallel or inclined truncation plane of the reflector, or may be limited in length of arc as shown in FIG. 3 according to the useful gain that it is necessary to obtain in order to strengthen the "full beam".

The spherical recuperator elements may be formed on any of the types of reflector having a truncation plane, including reflectors having evolutive facettes and/or progressive or monotonous evolutive conics.

Figure 6:
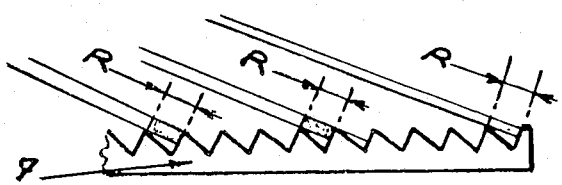
FIG. 6 is an enlarged view of a small portion of the reflector of FIG. 3, the spherical elements having a constant evolutive radius and a variable pitch.
Figure 7:
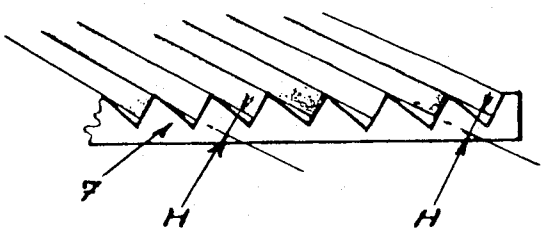
FIG. 7 is analogous to FIG. 6, the spherical elements having increasing evolutive radii, a variable pitch and a constant height of the useful zones of the reflective zones.

FIG. 5 shows schematically the constant pitch P of the spherical elements 7 having increasing evolutive radii, FIG. 6 shows the constant evolutive radius R of the spherical elements 7 having a variable pitch and FIG. 7 shows the constant useful height H of the useful zones of the spherical elements 7 having increasing evolutive radii and variable pitch.

Figure 8:
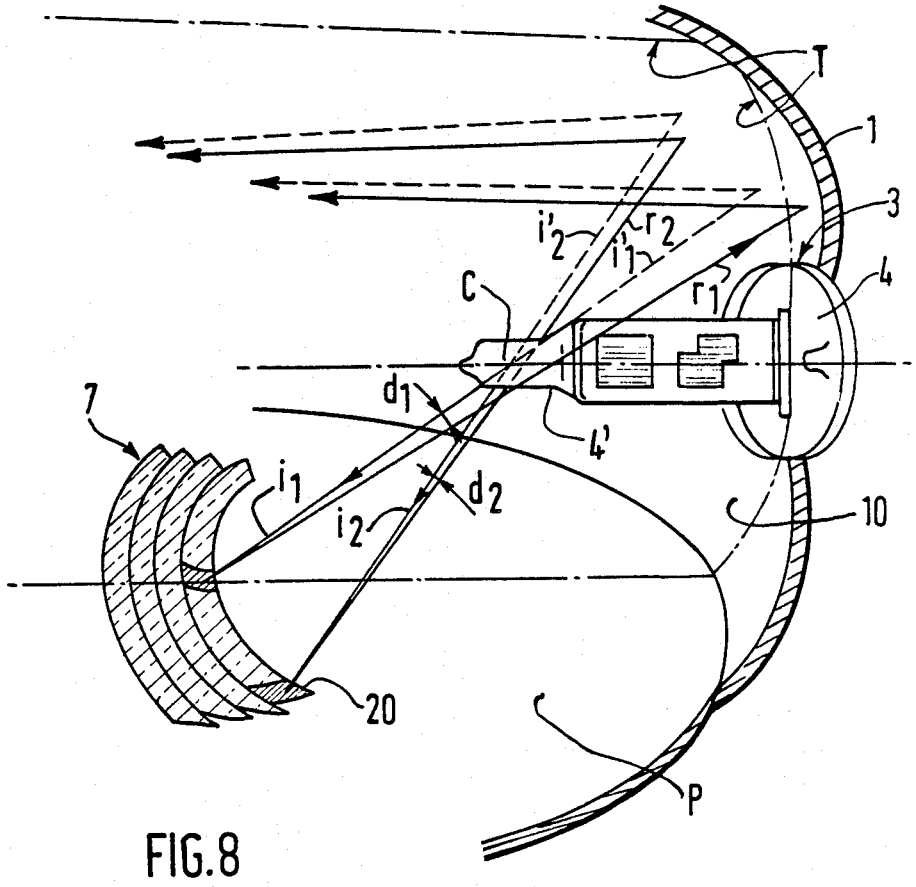
FIG. 8 is a diagram of a reflective system according to another example of embodiment of the invention.
Figure 9:
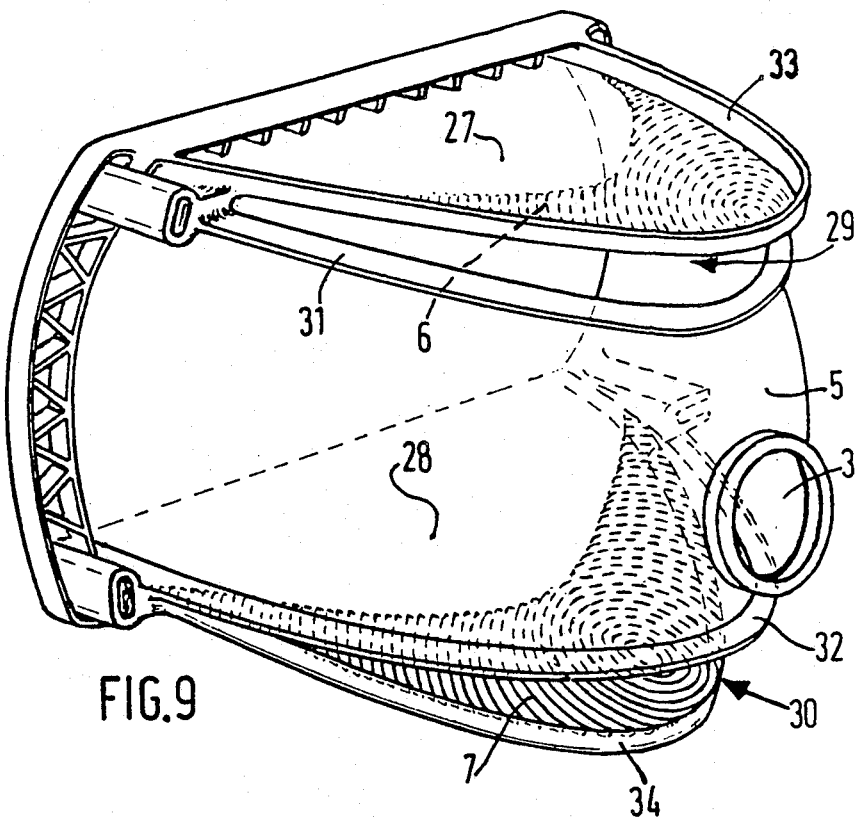
FIG. 9 is a schematic perspective view of a reflector according to a variant of embodiment of the invention.
Figure 10:
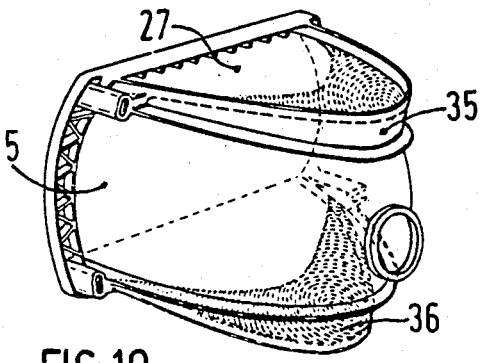
FIG. 10 is analogous to FIG. 9 for a variant of embodiment comprising an obturating veil formed during moulding, before metallization and protection.
Figure 11:
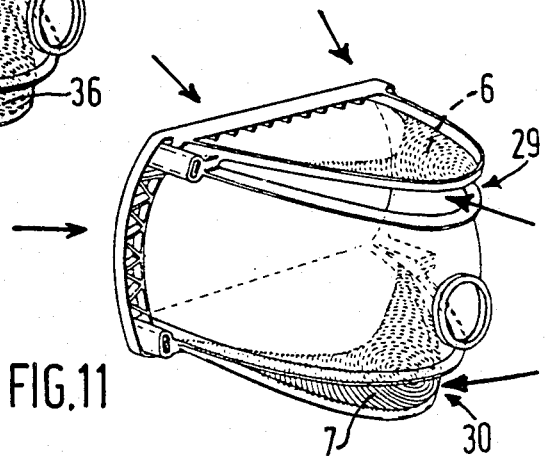
FIG. 11 represents the reflector of FIG. 10, after removal of the veil for the purpose of the metallization and protection operations.
Figure 12:
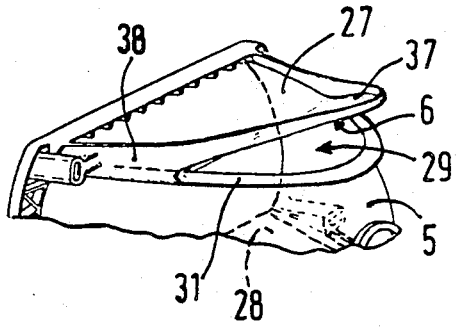
FIG. 12 is analogous to FIGS. 9 and 11 for a portion of a reflector according to a variant of this invention.

Reference is now made to FIG. 8.

The reflector 1 comprises a rear orifice 3 seating a lamp 4, the filament C of which emits incident rays $i_1$, $i_2$ forwards and $i'_1$ and $i'_2$ backwards. The rays $i'_1$, $i'_2$ are reflected on the reflector 1 formed by a reflecting conic 10 and the intersection of which with the vertical focal plane is shown at T.

The truncation plane P comprises spaced spherical elements 7 which, in accordance with the invention, are constituted of a plurality of microfacettes 20 orientated in such a manner that the reflected rays $r_1$ and $r_2$ of the incident rays $i_1$ and $i_2$, at the angles $d_1$ and $d_2$ respectively, are reflected on the conic 10 without having passed through the bulb 4'of the lamp 4 and thus complete and homogenize the beam of rays directly reflected by the conic and originating from the incident rays $i'_1$ and $i'_2$. In the case where a two-function lamp, not shown in the drawing, is used, the rays issuing from the full beam filament would also have reflections on the echelons 7 without passing through the lamp 4.

Preferably, at least a portion of the microfacettes 20 determines a monotonous evolutive surface.

Reference is now made to FIGS. 9–13.

The reflector comprises at the rear, an orifice 3 for mounting of the lamp and, at the front, an opening defining its useful lighting area, which opening is bounded by a reinforcing flange comprising various means for fixing and adjusting the orientation. Its reflecting quadric 5 is, in contrast, limited in height as a function of two truncation planes 27 and 28, equipped internally with spaced recuperation elements 6 and 7 intended for increasing the solid lighting angle of the quadric 5. For this reason, since the useful reflective surfaces of said spaced elements are orientated substantially - in opposition to the principal useful reflective surface of the quadric 5 - towards the rear of the reflector, said reflector is equipped, in accordance with this invention, with two rear openings or slits 29 and 30 formed between the truncation planes 27 and 28 and the upper and lower limits of the quadric 5, for the purposes notably of permitting effective metallization and protection of the useful surfaces of said recuperator elements. Also, the upper and lower limits of the quadric 5 in the immediate vicinity of said rear openings 29 and 30 are equipped with two reinforcing ribs 31 and 32, stiffening and externally continuing the external wall of the quadric 5. In a corresponding manner, the edge of each truncation plane is externally equipped with a rib 33, 34.

In order to ensure, during the fabrication of the reflector, the continuity of flow and satisfactory distribution within the mould of the material or materials constituting the structure of the reflector, each opening 29–30 is obturated by a veil of material 35–36 integrally formed in the moulding (FIG. 10), this veil being preferably situated on the external side of the structure of the reflecting quadric, in such a manner that it can subsequently be removed at least without risk of adversely effecting the polish of the internal surface of the reflector before the succeeding operations of metallization and protection of the useful reflective surface of the quadric 5 and the spaced recuperator elements 6 and 7.

Once the veil of material 35–36 which obturates each of the rear openings 29–30 (FIG. 11) has been removed, the reflector being fixed on the rotating supports of a satellite of the appropriate metallization equipment, all the internal surface of the reflector will be effectively exposed to the various jets of materials determined by the cycle chosen for metallization and protection, partly through the front opening for the principal useful surface of the quadric 5, partly through the rear openings 29–30 for each of the additional useful surfaces of the spaced recuperator elements 6 and 7.

The inclination of the truncation planes 27 and 28, the subordinate orientation of the additional useful reflecting surfaces of the recuperator elements 6 and 7, the limiting height and depth of the quadric 5, the lateral and vertical widths of the openings 29 and 30, are evidently functions of the dimensions, forms, inclinations and distance of the glass optic mounted in front of the opening of the reflector and of the automobile body volume available determined by the aerodynamic profile given to the carrying vehicle. Consequently, the inclination of the truncation planes 27 and 28 may be more accentuated in the rear part in such a way as to form a raised flap 37 as shown, by way of a non-limiting example, in the attached partial FIG. 12, which will then favour the rake angle of the spaced elements 6 and 7 in the moulding equipment and, consequently, the moulding, metallization and protection of said elements, will also reduce the width of the rear openings 29 and 39 and will enable other forms to be given to the reinforcing ribs 31 and 32 and the corresponding possible rim 33 of the raised flap 39, in such a manner as to obtain the appearance of projecting lips on the one hand and the form of reinforcing flanges 38 on the other hand.

Figure 13:
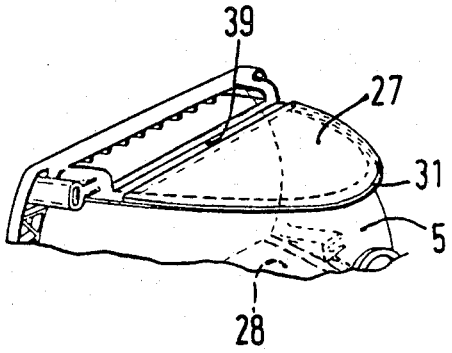
FIG. 13 is analogous to FIG. 12 for another variant of the invention.

In the form of embodiment of FIG. 13, the reflector in which, in order to facilitate its moulding, the truncation planes 27, 28 equipped with the spaced elements 6, 7 form at the end of this fabrication stage openings 29, 30 with the principal quadric 5 of the reflector, comprises in addition a reduction in thickness 39 of the wall of their junction zone to the front part of the reflector. This reduction in thickness 39 is intended for constituting a relatively flexible hinge, which will later permit, after the metallization and protection operations of the useful internal optical surfaces of the reflector, the truncation planes 27, 28 to be folded onto the upper and/or lower limiting zones of the quadric 5 and to be kept thus in this position of closure by fixing onto the ribs 31, 32 by any known fixing means, such as snap connections, welding, gluing, clipping etc.

Finally, the reflectors in accordance with this invention can clearly be installed in a protective housing and/or enveloped in any complementary envelope having appropriate characteristics for effectively protecting their external walls.

I claim

1. Reflector for automobile headlight, comprising a reflecting quadric having substantially the surface of a paraboloid of revolution intersected by upper and lower truncation planes, for use in combination with an electric lamp filament situated substantially at the focus of said quadric for providing full beam illumination by reflection on said quadric of the light beams emitted by said filament and traversed by an optic glass situated in front of said quadric, the improvement being that at least the lower truncation plane of the reflector is provided, on its internal surface illuminated by the full beam filament of the light generating lamp, with a plurality of spherical reflecting elements spaced in a concentric arrangement comparable with Fresnel echelons with respect to their common axis passing through the focus of the useful reflecting conic of the reflector, this focus being also their common centre.

2. Reflector according to claim 1, wherein spherical reflecting elements, concentrically spaced on the truncation plane, have, with respect to their common centre passing through the focus of the reflecting quadric of the reflector, increasing evolutive radii to progress annularly at a constant pitch towards the opening plane of the reflector or limiting plane of the truncation plane, the nonreflecting rakes of each groove of prismatic section thus formed on the truncation plane being constructed in such a manner that each limiting ray emitted by the lamp which illuminates the base of the groove is returned towards the lamp without skimming the plane formed by said rakes.

3. Reflector according to claim 1, wherein the spherical reflecting elements concentrically spaced on the truncation planes have, with respect to their common centre passing through the focus of the reflecting quadric of the reflector constant evolutive radii to progress annularly at a variable progressive pitch towards the opening plane of the reflector and limiting plane of the truncation plane, the reflection of each intercepted ray being not capable of skimming the flank of the corresponding rakes of each optical concentric groove formed (FIG. 6).

4. Reflector according to claim 1, wherein spherical reflecting elements spaced concentrically on the truncation plane have, with respect to their common centre passing through the focus of the reflecting quadric of the reflector increasing evolutive radii such that they provide a variable pitch and a constant height of the useful zone of said spherical elements illuminated by the useful incident rays emitted by the "full beam" filament of the lamp, the rays reflected by said zones not skimming the flanks formed by the rake of each groove formed (FIG. 7).

5. Reflector according to claim 1, wherein each reflecting surface of the spaced spherical elements of the reflector is constituted by the juxtaposition of a plurality of microfacettes orientated individually in such a manner as to reflect the incident rays ($i_1$, $i_2$), intercepted dipped beam rays and/or full beam rays, which they must send back to the useful surface of the conic of the quadric, with a deviation ($d_1$, $d_2$) in the angle of reflection such that these reflected rays ($r_1$, $r_2$) avoid passing through the bulb of the lamp and, after a second reflection by the corresponding zone of the useful reflecting surface of the reflector conic, complete and homogenize the basic lighting beam obtained by reflection of the rays only ($i'_1$, $i'_2$) of the light source which directly illuminate the reflecting surface of said principal conic of the reflector.

6. Reflector according to claim 5, wherein juxtaposition, dimensional evolution and orientation of the orientated reflecting microfacettes determine, for a portion or the whole of the spaced elements and a portion or the whole of the reflecting surface of each of said echelons a monotonous evolutive surface.

* * * * *

UNITED STATES PATENT OFFICE

CERTIFICATE OF CORRECTION

Patent No. 4,794,504 Dated December 27, 1988

Inventor(s) Rene LeCreff

It is certified that error appears in the above-identified patent and that said Letters Patent are hereby corrected as shown below:

Title page item [19] should read --LeCreff-- item [75] should read --Rene LeCreff--.

Signed and Sealed this

Eighteenth Day of April, 1989

*Attest:*

*Attesting Officer*

DONALD J. QUIGG

*Commissioner of Patents and Trademarks*